United States Patent [19]

Wisbey et al.

[11] Patent Number: 4,847,535

[45] Date of Patent: Jul. 11, 1989

[54] HYBRID BALLAST FOR MULTIPLE DISCHARGE LAMPS

[75] Inventors: Robert W. Wisbey, Arlington Heights; Joseph S. Droho, Chicago, both of Ill.

[73] Assignee: Advance Transformer Co., Chicago, Ill.

[21] Appl. No.: 566,944

[22] Filed: Dec. 30, 1983

[51] Int. Cl.[4] ..... H05B 41/16

[52] U.S. Cl. ..... 315/101; 315/244; 315/243; 315/103

[58] Field of Search ..... 315/103, 244, 243, 101

[56] References Cited

U.S. PATENT DOCUMENTS

| | | | |
|---|---|---|---|
| 3,665,243 | 5/1972 | Kaneda et al. | 315/101 |
| 3,836,817 | 9/1974 | Tschang et al. | 315/101 |
| 3,983,449 | 9/1976 | Dear et al. | 315/244 |
| 4,145,638 | 3/1979 | Kaneda et al. | 315/101 |
| 4,253,043 | 2/1981 | Chermin et al. | 315/245 |
| 4,380,719 | 4/1983 | De Bijl | 315/101 |
| 4,406,976 | 9/1983 | Wisbey et al. | 315/244 |

FOREIGN PATENT DOCUMENTS 921917 5/1947 France .

*Primary Examiner*—Leo H. Boudreau
*Assistant Examiner*—Michael Razavi
*Attorney, Agent, or Firm*—Bernard Franzblau

[57] ABSTRACT

A hybrid ballast apparatus for starting and operating a plurality of series-connected discharge lamps and which provides protection against electric shock. The ballast apparatus includes first and second bidirectional thyristors connected in parallel with first and second ones of said lamps, respectively, and a trigger control circuit for simultaneously triggering the thyristors into conduction. Each lamp has two filaments and means are provided for connecting an L-C ballast device, the lamp filaments and the first and second thyristors in a series circuit across the AC supply voltage terminals. If one end of a lamp is removed from its socket, the series circuit is opened so that the maximum voltage at any lamp electrodes is limited to the AC supply voltage.

7 Claims, 2 Drawing Sheets

HYBRID BALLAST FOR MULTIPLE DISCHARGE LAMPS

BACKGROUND OF THE INVENTION

This invention relates to ballast devices for igniting and stablizing the operation of two or more electric discharge lamps, and more particularly to an improved hybrid ballast apparatus which provides high efficiency and superior protection against the hazard of electrical shock.

One prior art hybrid ballast apparatus is described in U.S. Pat. No. 4,253,043 issued Feb. 24, 1981 in the name of Chermin et al. The basic Chermin et al system comprises two series-connected discharge tubes stabilized by means of a relatively small ballast. The two series-connected tubes are shunted by a single semiconductor switching element with a bidirectional thyristor characteristic (e.g. a Triac). The control circuit of the semiconductor switching element includes a non-linear voltage dependent circuit element (e.g. a VDR) which is operative to prevent ignition of the discharge tube before the tube filaments heat up. A limitation of the Chermin et al system is that it does not comply with the pertinent safety requirements as to electric shock hazard to persons contacting one pair of tube electrodes while the other pair of electrodes are still in the tube socket.

An improvement over the ballast apparatus shown in the Chermin et al patent is described in U.S. Pat. No. 4,406,976 issued Sept. 27, 1983 in the names of Wisbey and Droho. This patent discloses a hybrid ballast circuit that employs a non-linear voltage dependent resistor (e.g. a Varistor) connected across the ballast capacitor so as to limit the capacitor peak voltage to a predetermined level. This feature thereby limits the maximum voltage appearing between any lamp electrode and ground to a safe value within the specified safety limits. However, although the Wisbey-Droho apparatus was effective to limit the lamp voltages (socket-to-ground) to acceptable safe levels, starting of the lamps in a two lamp series-connected arrangement energized from a 120 volt, 60 Hz AC supply source was not always satisfactory.

SUMMARY OF THE INVENTION

Accordingly, it is an object of the invention to provide a novel ballast apparatus that automatically limits the voltage levels appearing at the discharge lamp electrodes to a maximum value that is within specified safety limits such as to prevent the hazard of electric shock to a person coming in contact therewith.

Another object of the invention is to provide a hybrid ballast system that at all times operates within specified safety levels for the electrode voltages and still provides reliable starting and operating characteristics for the lamps in a multiple-lamp system.

A further object of the invention is to provide a novel hybrid ballast circuit configuration that produces an economical wiring layout in a fluoroescent fixture such that the input power cord can come in directly at one end of the fixture and be connected to the lamp sockets so that only two wires are required to run the length of the lamps to complete the wiring to the other end of the fixture.

These and other objects and advantages are achieved in accordance with the invention by providing a hybrid ballast circuit for at least first and second series-connected discharge lamps which comprises first and second simultaneously firing thyristors adapted to be connected in parallel with the first and second lamps, respectively. The hybrid ballast includes a series circuit connected across the 60 Hz AC supply terminals that is composed of a capacitor and an inductor together forming a ballast device, the filaments of the series-connected discharge lamps, and the two thyristors.

The two simultaneously firing thyristors, one in parallel with each of the two lamps, allows the circuit to generate voltages that are higher than those that would be allowed at any exposed lamp end because the high voltage generation circuit comprises the aforesaid series circuit of the L-C ballast device, the two thyristors and all four lamp filaments. If any one of these elements is removed the series loop is broken so that the highest voltage that can then be present at any lamp electrode will be the line voltage. There is also no current flow through the remaining lamp filaments so that the filaments will not be heated. A high voltage now would be required to cause lamp ionization. The line voltage will not ignite lamps with cold filaments. As a result, if one end of any lamp is removed and is then contacted by a person, there will be no hazardous voltage available.

In the prior art multi-lamp series circuits only a total of two lamp filaments have been connected in the series loop across the input supply terminals. Any additional filaments were usually supplied in parallel from a separate transformer filament winding. In the circuit of U.S. Pat. No. 4,406,976 the circuit values were chosen to limit the voltage in the event that one of the lamp ends was removed. The novelty of that circuti was the use of a voltage dependent resistor in parallel with the LC ballast combination so as to limit the voltage available from any socket to ground.

In accordance with the novel hybrid ballast circuit of our invention, voltages can be generated to obtain reliable starting and flicker-free operation of two 40 Watt lamps from a 120 volt AC supply. Additional combinations of lamp ratings, supply voltages and number of lamps can be started and operated reliably and safely. Design choices need not be restricted by the limitations of the maximum safe voltage to ground since the circuit becomes inactive if any lamp end is removed from its socket.

BRIEF DESCRIPTION OF THE DRAWINGS

The foregoing and other objects and advantages of the invention will become apparent from the following detailed description thereof taken in conjunction with the accompanying drawings, in which.

DESCRIPTION OF THE PREFERRED EMBODIMENTS

Figure 1:
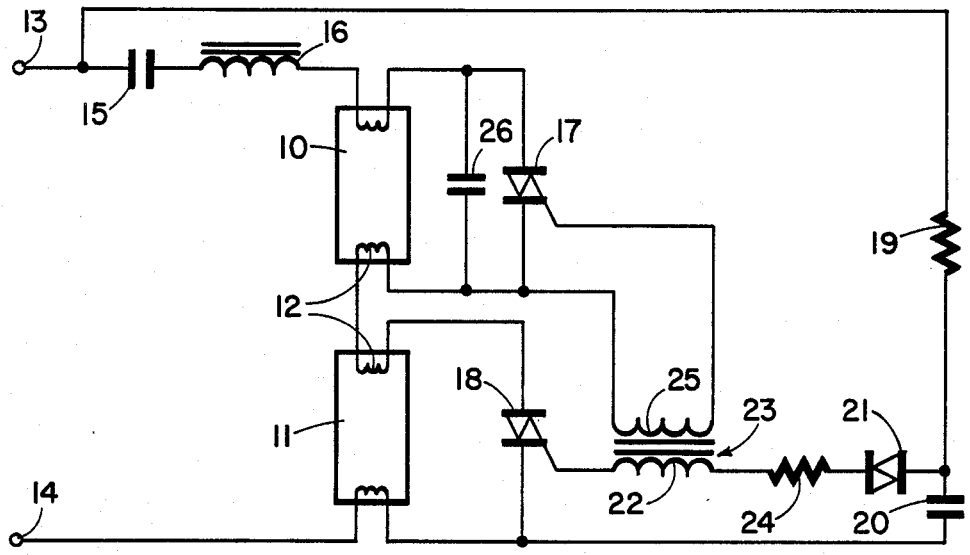
FIG. 1 is a circuit diagram of a first embodiment of an improved hybrid ballast apparatus in accordance with the invention.

Referring to the drawings wherein the same reference numerals are used to designate identical or corresponding elements in the different figures, FIG. 1 shows a hybrid ballast circuit for igniting and operating a pair of series-connected discharge lamps 10 and 11. Each of the lamps include a pair of filaments 12 at opposite ends of the lamp. The discharge lamps 10 and 11 are energized from a pair of input terminals 13 and 14 adapted for connection to a source of AC supply voltage, for example, 120 volts, 60 Hz. A ballast device consisting of a capacitor 15 and an inductor 16 is connected in series circuit between input terminal 13 and one end of the upper filament 12 of discharge lamp 10.

A bidirectional thyristor device 17 (e.g. a Triac) is connected between the other end of upper filament 12 of lamp 10 and one end of lower filament 12 of this lamp, whereby Triac 17 is effectively connected in parallel with the lamp 10. One end of the lower filament 12 of discharge lamp 11 is directly connected to the other input supply terminal 14. In a similar manner to Triac 17, a Triac 18 is connected to the other ends of upper and lower filaments 12 of lamp 11 so that the Triac 18 is in parallel with the lamp 11. The left-hand terminals of the lower filament of lamp 10 and the upper filament of lamp 11 are directly connected together.

A trigger control circuit for the thryistors 17 and 18 includes a resistor 19 and a capacitor 20 connected in series circuit between input terminal 13 and the junction point betweeen triac 18 and the lower filament 12 of lamp 11. One terminal of a voltage sensitive switch 21 (e.g. a Diac) is connected to the junction point between resistor 19 and capacitor 20 and the other terminal of Diac 21 is connected to one terminal of the primary winding 22 of a pluse transformer 23 via a resistor 24. The other terminal of primary winding 22 is connected directly to the gate electrode of Triac 18. The secondary winding 25 of the pulse transformer is connected across the gate circuit of Triac 17. The trigger circuit thus triggers the triacs 17 and 18 independently of the current flow therein. A capacitor 26 is connected in shunt with the lamp 10 to improve the starting characteristics in accordance with the known sequential starting technique for series-connected discharge lamps.

Resistor 19, capacitor 20, and voltage sensitive switch 21 combine to generate a trigger pulse at a predetermined time in each half cycle of the AC supply voltage appearing at terminals 13 and 14. This trigger pulse is coupled through resistor 24 and the primary winding of pulse transformer 23 directly to the gate of Triac 18. The secondary winding of pulse transformer 23 applies the trigger pulse to the gate of Triac 17. Resistor 24 and the inductance of pulse transformer 23 and capacitor 20 shape the trigger pulse so that the gate energy pulses are of sufficient magnitude and duration to ensure proper turn-on of both Triacs simultaneously under all conditions. When the Triacs are turned on a series loop is then formed consisting of capacitor 15, inductor 16, Triacs 17 and 18, and the four lamp filaments. Since the resistance of each of the filaments is relatively small compared to the inductance and capacitance values in the series loop, a resonant charge results. This resonant charge supplies a relatively high preheating current to the filaments while simultaneously charging capacitor 15 to a voltage level well above the input voltage. When the resonant current crosses zero the Triacs naturally turn off, leaving capacitor 15 charged to its peak value. A series loop now exists consisting of the input voltage source, capacitor 15, inductor 16 and the two lamps. After several cycles of current flow have occurred, sufficient for the filaments to be adequately heated, the votlage stored on capacitor 15 will be sufficient to start the lamp arcs. Capacitor 26 in parallel with the lamp 10 allows this voltage to be instantaneously applied to the two lamps in succession so as to insure better starting of the lamps.

Once the lamps have started the circuit continues to operate with the Triacs turning on each cycle. This allows current to flow through the lamps for the major part of each half-cycle, but then current flows through the parallel paths of the Triacs and through the filaments for a period at the end of each half-cycle. This insures continued heating of the filaments in the operating condition of the lamps and also provides a voltage charge on the capacitor 15 that is higher than the line voltage. The capacitor voltage is then available for the reignition of the lamps during each new half-cycle. Operation of more than two lamps requires one additional Triac for each additional lamp, connected in parallel with each lamp, and one additional secondary winding on pulse transformer 23 to trigger each additional triac.

Figure 2:
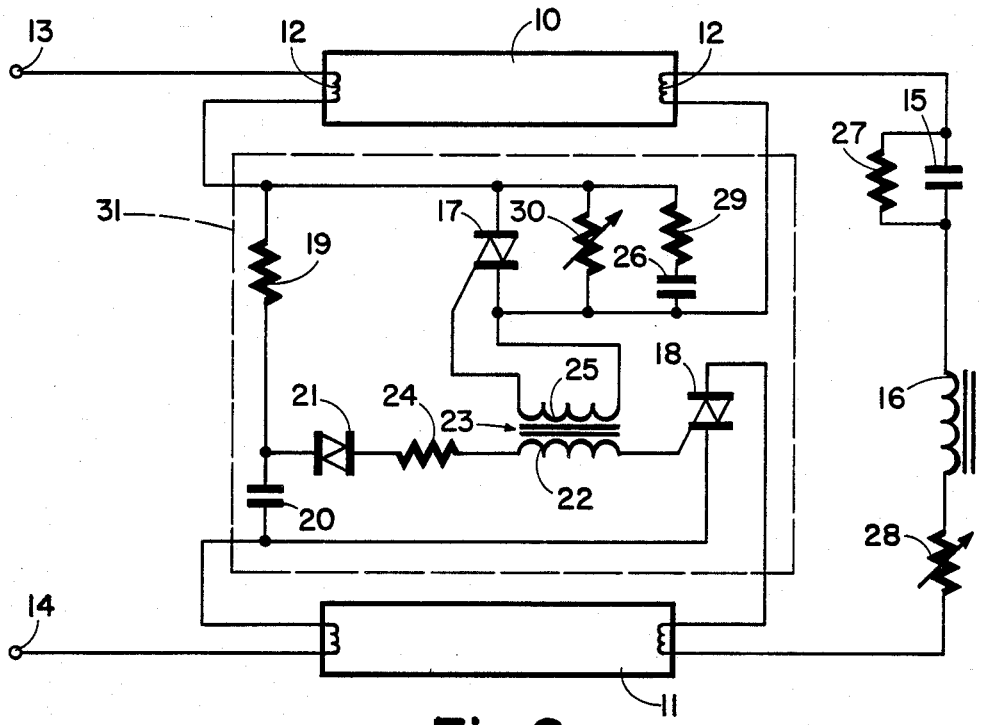
FIG. 2 is a circuit diagram of a second embodiment of the novel hybrid ballast apparatus by means of which the wiring in a two-lamp fixture is reduced.

FIG. 2 illustrates a second embodiment and a second aspect of the invention. Input terminals 13 and 14 are again intended for connection to the AC supply line voltage, preferably 120 volts, 60 Hz. Terminals 13 and 14 are each directly connected to one terminal of the filaments 12 of lamps 10 and 11, respectively. The Triac 17 is again connected in parallel with lamp 10 and the Triac 18 is connected in parallel with lamp 11.

The capacitor 15 and inductor 16 forming the ballast device for the two lamps 10 and 11 are now serially connected between the two lamps, i.e. between the right hand filaments 12 of the lamps 10 and 11. A resistor 27 of relatively large resistance value is connected across the ballast capacitor 15 in order to provide a discharge path for the capacitor so that no residual charge is left on the capacitor after the circuit has been turned off. An optional feature is the provision of a positive temperature coefficient (PTC) resistor 28 connected in the series circuit with capacitor 15 and inductor 16 between the two lamps. In the event that the lamps refuse to start and the lamp filaments are intact, the PTC resistor will heat up and switch over to its high resistance state to limit the current flow and effectively disable the circuit even if the starting cycle persists, thereby protecting the circuit elements from damage. The PTC resistor can also sense the temperature of the inductor and shut the system down in the event it overheats due to any cause.

A resistor 29 may be connected in series with the starting capacitor 26 across the terminals of discharge lamp 10. This resistor serves to slow the discharge of capacitor 26 through the Triac 17 thereby insuring that the rate of change of the current (di/dt) through the Triac device does not exceed its rating. The resistor also operates to maintain the Triac current above the holding current level of the device for a slightly longer period of time so that the Triac is latched more definitely into the conduction state.

A voltage dependent resistor (VDR) 30 may be connected in parallel with Triac 17 so as to protect the Triac from damage due to transient voltage surges.

Figure 3A:
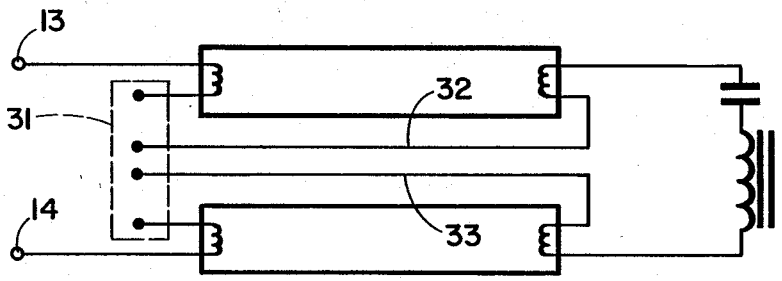
FIGS. 3A and 3B illustrate how the hybrid ballast circuit of FIG. 2 reduces the amount of wiring in a two-lamp fixture.
Figure 3B:
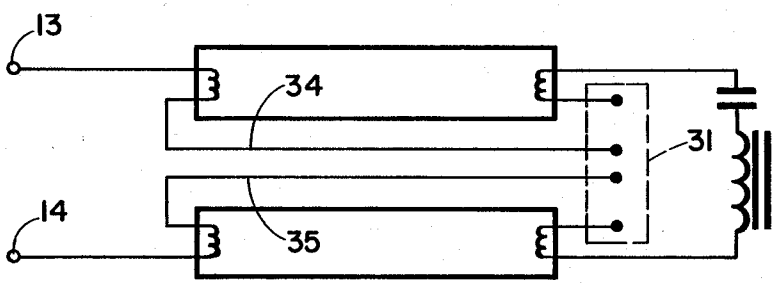

The circuit of FIG. 2 functions similarly to the circuit of FIG. 1 but the novel circuit configuration makes it possible to use an absolute minimum of wiring within a two lamp fixture. Fixtures of this type may be equipped with a cord and plug set at the input. In this circuit configuration the two input leads can be brought in directly to the socket terminals in one end of the fixture. Inductor 16 and capacitor 15 can be mounted at the opposite end of the fixture, interconnected and each of their remaining leads can be connected directly to a socket terminal. The remaining components can be mounted on a circuit board indicated by the dashed line box 31 which can be equipped with four external leads. The circuit board can be mounted in the middle of the fixture. It can also be fitted with two terminals that would connect directly to socket terminals in the end of the fixture in which it is mounted, as shown in FIG. 3A, and then be equipped with two leads 32 and 33 which go directly to the two sockets at the other end of the fixture. This procedure can be reversed, as shown in FIG. 3B where the circuit board assembly 31 is mounted at the same end of the fixture as the inductor and capacitor with its terminals interconnected directly to the socket terminals and with two further leads 34 and 35 going back to the input end of the fixture. In either of these arrangements the amount of wiring required in the fixture is considerably less than with other two lamp ballast configurations now available.

Typical values for the various components of the ballast circuit of FIG. 2 are as follows:

| | |
|---|---|
| Lamps 10 and 11 | F40T12-RS |
| Capacitor 15 | 8 μF |
| Inductor 16 | 330 mHy |
| Resistor 19 | 91K ohm |
| Resistor 24 | 220 ohm |
| Resistor 29 | 10 ohm |
| Resistor 30 | 600 V varistor |
| Resistor 27 | 5.6 M ohm |
| Resistor 28 | PTC ≦ 6 ohm |
| Capacitor 20 | 0.56 μF |
| Capacitor 26 | 0.05 μF |
| Thyristor 17, 18 | Triac (600 V, 1 A) |
| Voltage Sensitive Switch 21 | SBS (8 V) |
| Transformer 23 | 1:1 pulse transformer |

The improved hybrid ballast apparatus described above will operate two or more fluorescent lamps in series and will still comply with the pertinent safety requirements since the high voltage generating elements of the system will be deactivated and no filament heating will occur if any end of any lamp is removed from its socket. Therefore, voltages can be generated to provide reliable starting and flicker free operation of two or more discharge lamps since there are no design restrictions on the voltages produced because of safety requirements. The embodiment of the invention shown in FIG. 2 has the further advantage that it simplifies and reduces the wiring requirements of a two-lamp fixture.

While the hydrid ballast apparatus has been described in detail herein in connection with certain preferred embodiments thereof, various modifications will become apparatus to those skilled in the art. Therefore, it is to be understood that the invention is to be limited only by the scope of the appended claims and not by the specific details described in the preferred embodiments.

We claim:

1. A ballast apparatus for energizing at least two series-connected discharge lamps having preheatable filaments comprising:

a capacitor, an inductor, means for connecting the capacitor, the inductor and first and second ones of the series-connected lamps in a series circuit across a source of AC supply voltage, first and second bidirectional controlled semiconductor devices adapted to be connected in parallel with said first and second lamps, respectively, so that a second series circuit will be formed across said source of AC supply voltage that includes the capacitor, the inductor, the filaments of each lamp, and the controlled semiconductor devices, and a trigger control circuit coupled to at least one side of said AC supply voltage and to control electrodes of the first and second controlled semiconductor devices so as to simultaneously apply a trigger voltage pulse to said control electrodes at a predetermined time during each half cycle of the AC supply voltage thereby to simultaneously trigger the controlled semiconductor devices into conduction, wherein the trigger control circuit comprises;

a resistor and a second capacitor coupled to said source of AC supply voltage, a voltage threshold device, and means including the voltage threshold device for coupling the second capacitor to the control electrodes of the first and second controlled semiconductor devices, and wherein the coupling means of the trigger control circuit further comprises:

a second resistor, a pulse transformer having a primary winding and a secondary winding, said voltage threshold device, said second resistor and said primary winding being connected in series circuit between the second capacitor and the control electrode of one of said controlled semiconductor devices, and means connecting the secondary winding of the pulse transformer to the control electrode of the other of said controlled semiconductor devices.

2. A ballast apparatus as claimed in claim 1 wherein said controlled semiconductor devices each comprise a triac and wherein the second resistor, the second capacitor and the pulse transformer are chosen so as to shape the trigger pulse so that it has sufficient magnitude and duration to ensure simultaneous turn-on of the triacs under all operating conditions

3. A ballast apparatus for energizing at least two series-connected discharge lamps having preheatable filaments comprising:

a capacitor, an inductor, means for connecting the capacitor, the inductor and first and second ones of the series-connected lamps in a series circuit across a source of AC supply voltage and with the capacitor, the inductor and a PTC resistor connected in series circuit between the first and second lamps, first and second bidirectional controlled semiconductor devices adapted to be connected in parallel with said first and second lamps, respectively, so that a second series circuit will be formed across said source of AC supply voltage that includes the capacitor, the inductor, the filaments of each lamp, and the controlled semiconductor devices, and a trigger control circuit coupled to at least one side of said AC supply voltage and to control electrodes of the first and second controlled semiconductor devices so as to simultaneously apply a trigger voltage pulse to said control electrodes at a predetermined time during each half cycle of the AC supply voltage thereby to simultaneously trigger the controlled semiconductor devices into conduction.

4. A ballast apparatus as claimed in claim 2 wherein the PTC resistor is connected in series circuit with one of said controlled semiconductor devices.

5. A ballast apparatus for energizing at least two series-connected discharge lamps having preheatable filaments comprising:

a capacitor, an inductor, means for connecting the capacitor, the inductor and first and second ones of the series-connected lamps in a series circuit across a source of AC supply voltage and with the capacitor and the inductor connected in series between the first and second lamps, first and second bidirectional controlled semiconductor devices adapted to be connected in parallel with said first and second lamps, respectively, so that a second series circuit will be formed across said source of AC supply voltage that includes the capacitor, the inductor, the filaments of each lamp, and the controlled semiconductor devices, and a trigger control circuit coupled to at least one side of said AC supply voltage and to control electrodes of the first and second controlled semiconductor devices so as to simultaneously apply a trigger voltage pulse to said control electrodes at a predetermined time during each half cycle of the AC supply voltage thereby to simultaneously trigger the controlled semiconductor devices into conduction, wherein the tirgger control circuit comprises:

a resistor and a second capacitor connected in series between a first filament of the first discharge lamp and a first filament of the second discharge lamp, and a voltage threshold device coupling the second capacitor to the control electrodes of the first and second controlled semiconductor devices.

6. A ballast apparatus for energizing at least two series-connected discharge lamps having preheatable filaments comprising:

a capacitor, an inductor, means for connecting the capacitor, the inductor and first and second ones of the series-connected lamps in a series circuit across a source of AC supply voltage and with the capacitor and the inductor connected in series between the first and second lamps, first and second bidirectional controlled semiconductor devices adapted to be connected in parallel with said first and second lamps, respectively, so that a second series circuit will be formed across said source of AC supply voltage that includes the capacitor, the inductor, the filaments of each lamp, and the controlled semiconductor devices, a resistor and a second capacitor connected in a third series circuit coupled in parallel with said first lamp and said first controlled semiconductor device whereby the resistor determines the discharge time of the second capacitor through the first controlled semiconductor device, and a trigger control circuit coupled to at least one side of said AC supply voltage and to control electrodes of the first and second controlled semiconductor devices so as to simultaneously apply a trigger voltage pulse to said control electrodes at a predetermined time during each half cycle of the AC supply voltage thereby to simultaneously trigger the controlled semiconductor devices into conduction.

7. A ballast apparatus as claimed in claim 6 further comprising:

a voltage dependent resistor connected in parallel with said first controlled semiconductor device.

* * * * *